US005950558A

United States Patent [19]

Strong

[11] Patent Number: 5,950,558

[45] Date of Patent: Sep. 14, 1999

[54] FOAM AND CONCRETE FLOAT APPARATUS AND METHOD OF FABRICATION

[76] Inventor: Gardner Strong, 22 Olive Ave., Piedmont, Calif. 94611

[21] Appl. No.: 08/972,373

[22] Filed: Nov. 18, 1997

[51] Int. Cl.[6] ..... B63B 35/44

[52] U.S. Cl. ..... 114/267; 114/263; 405/218

[58] Field of Search ..... 114/45, 266, 267, 114/263; 405/218, 219

[56] References Cited

U.S. PATENT DOCUMENTS 4,559,891 12/1985 Shorter, Jr. ..... 114/267
5,050,524 9/1991 Kyhl et al. ..... 114/266

*Primary Examiner*—Jesus D. Sotelo
*Attorney, Agent, or Firm*—Bielen, Peterson & Lampe

[57] ABSTRACT

A float module that can be combined with other float modules to form a floating dock apparatus with the float module being constructed with a flat concrete deck bonded with a construction grade adhesive to a closed-cell foam pontoon, the exposed surfaces of the pontoon being covered with a protective coating, particularly one having anti-fouling properties.

15 Claims, 1 Drawing Sheet

FOAM AND CONCRETE FLOAT APPARATUS AND METHOD OF FABRICATION

BACKGROUND OF THE INVENTION

This invention relates to a foam and concrete float apparatus that is particularly adapted for use in a marina as a floating dock or mooring for pleasure boats and other water craft. The foam and concrete float apparatus is constructed with a plurality of float modules that are interconnected to provide for walkways, finger slips and other structural arrangements that form a marina dock layout or other floating platform. The float module combines a closed-cell foam pontoon that is securely bonded to a flat concrete deck. The foam and concrete float apparatus is combined with other modules, generally using elongated wooden stringers that interconnect adjacent modules.

Prior art float modules have been devised for marina docks using a foam pontoon enclosed in a concrete shell with a contiguous concrete deck wherein the foam is completely encapsulated in concrete. The cost and complexity of fabricating such a float can be avoided by the preferred design of the present invention. In addition to simplicity of fabrication, the foam and concrete float apparatus of this invention is lighter in weight and more easily modified and configured then pre-existing structures.

Prior art concrete floats are constructed by a complicated process involving installing a foam blank in an expensive, deep mold into which a concrete slurry is poured. In the subject invention the deck can be fabricated using an inexpensive, shallow rectangular form. The foam blank is thereafter bonded to the exposed concrete surface shortly after curing. Finally, an inexpensive coating is sprayed or troweled onto the exposed foam to protect the foam from marine organisms where necessary. The modules are assembled as desired.

SUMMARY OF THE INVENTION

The foam and concrete apparatus of this invention comprises a simple design for a float module that can be assembled with other modules to construct a float apparatus that is suitable for a marina or for simple use as a dock or docking platform. The foam and concrete float apparatus has the advantages of the durability of a concrete float, but with low fabrication and assembly costs. The basic float module includes a foam pontoon that is bonded to a concrete deck using a construction grade adhesive. The foam pontoon is a closed cell, expanded polystyrene blank that is used in rectangular block form or trimmed and configured for a particular use. The coupled foam pontoon and concrete deck are preferably coated with a protective material. For example, the foam pontoon is coated with a thixotropic plastic such as a single composition polyurethane. The deck may be coated with a suitable sealing agent or a special decking mat that can either be bonded to the deck after removal from the form in which the deck piece is formed, or, directly bonded to the deck by placement onto the bottom of the form prior to filling with concrete.

To facilitate the interconnection of multiple float modules, the concrete deck is poured in a simple rectangular form with a flat bottom with the form having sides with holes for insertion of hollow, cross tubes. The cross tubes provide a passage for elongated rod bolts that secure longitudal stringers to the sides of the concrete deck. In this manner, multiple float modules can be strung together to form a continuous weLlkway.

These and other features of this invention will become apparent upon consideration of the detailed description of the preferred embodiments.

DETAILED DESCRIPTION OF THE PREFERRED EMBODIMENTS

Figure 1:
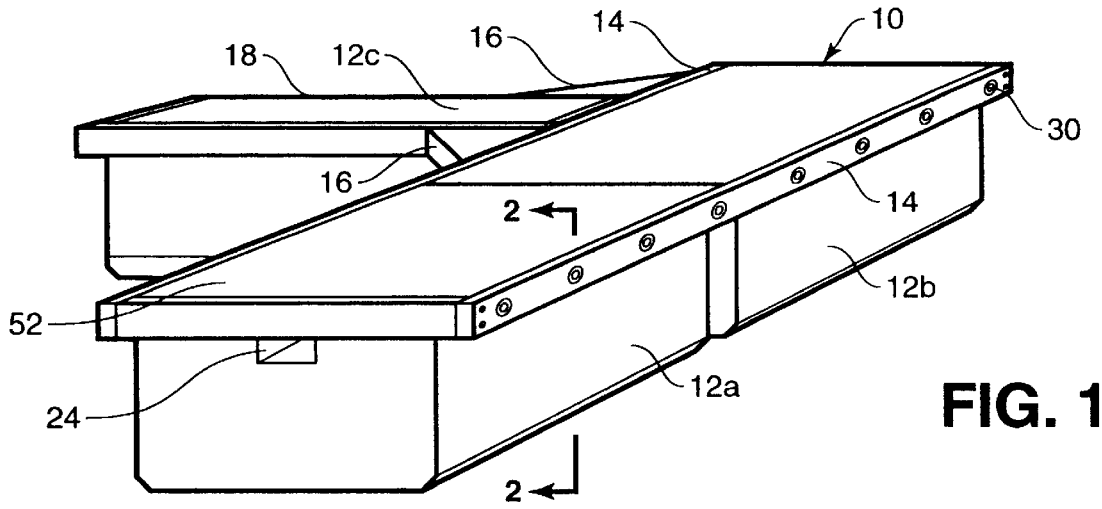
FIG. 1 is a perspective view of the foam and concrete float apparatus of this invention.

Referring to the perspective view in FIG. 1, the foam and concrete float apparatus of this invention is shown as a segment of a larger floating dock system suitable for a marina. The float apparatus, designated generally by the reference numeral 10, includes three float modules 12*a*, 12*b* and 12*c* that are interconnected to form a "T-shaped" structure. In the arrangement of FIG. 1, the primary modules 12*a* and 12*b* are interconnected by an elongated stringers 14 to provide a walkway from which a narrower, lateral float module 12*c* is attached using braces 16 to provide a slip finger 18 that is usually extended in pairs for defining a single craft or double craft boat slip.

Figure 2:
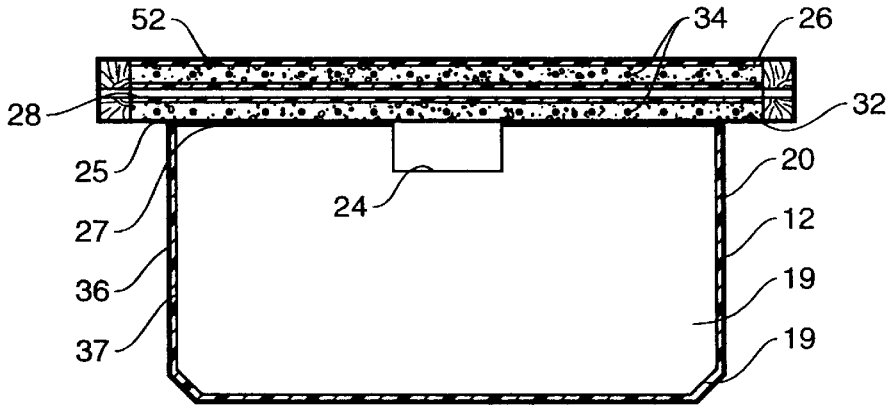
FIG. 2 is a cross sectional view of a float module taken on the lines 2—2 and FIG. 1.

Referring to FIG. 2, the float module 12 is constructed with a closed-cell, expanded polystyrene foam blank 19 forming a pontoon 20. The foam pontoon 20 has shaved exposed bottom edges 22 and a hollowed out center channel 24 that is suitable for a utility chase. The foam pontoon 20 is bonded to the underside 25 of a flat, rectangular, concrete deck 26 with a construction grade adhesive that has a solvent that is not incompatible with the composition of the foam blank 19. The construction grade adhesive has an adherence to the foam that is equal or better than the shear strength of the foam. The adhesive is applied in a layer 27 to one or both of the pontoon and deck during fabrication. The deck 26 includes a plurality of pre-installed conduits 28 that provide for passage of elongated rod bolts 30 that secure the elongated stringers 14 to the projecting edge 32 of the deck 26 during assembly of the typical float apparatus. As shown in the cross sectional view of FIG. 2, the deck 26 preferably includes two layers of a wire reenforcing mesh 34 arranged above and below the conduits 28 to strengthen the concrete deck 26.

Because of the ease of construction of a float module, different foam blanks, with different lengths and widths can be fabricated with little expense and coupled to decks of different size for the particular configuration of the assembled dock structure desired.

Although the concrete deck 26 and the bonded foam blank 19 are suitable for fresh water use, it is preferred that the foam blank 19 have a protective coating 36. The protective coating 36 can comprise a fiber reinforced sand and cement plaster that is sprayed or troweled onto the external surface 37 of the foam blank 19, a thin layer of cast-on concrete, or a sprayed or troweled plastic composition. It has been found that a thin layer of polyurethane that is troweled on provides an easily installed coating having thixotropic properties. Preferably the coating is a paste or mastic that provides some protection from the elements when cured, and includes a micro-organism inhibitor to prevent marine organisms from attacking the foam blank 19. Alternately, an inexpensive bituminous mastic or other coating having natural anti-fouling properties can be used.

Figure 3:
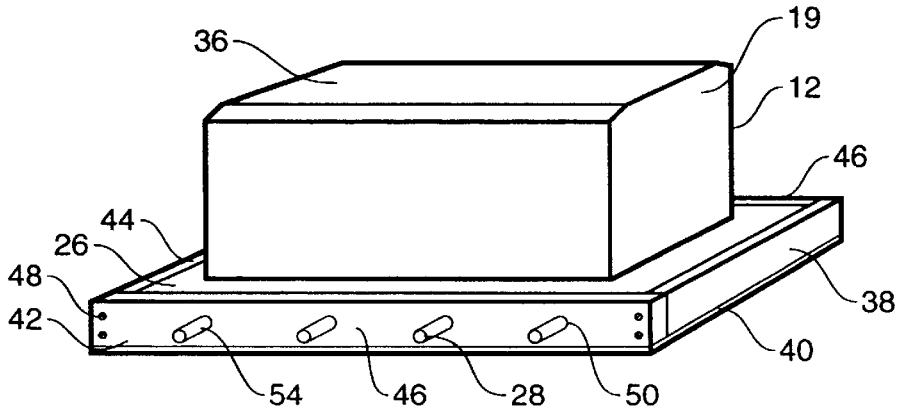
FIG. 3 is a schematic perspective view of the foam and concrete float apparatus during fabrication.

The simple process of fabricating the float module 12 is illustrated in the schematic view of FIG. 3. Referring to FIG. 3, a form 38 is formed with a base 40 that may be fabricated from a 4 foot by 10 foot by ¾ inch panel of plywood to which a rectangular side frame 42 is mounted. The side frame 42 may be formed of 2 inch by 6 inch planks that either frame the base 40 or are seated on top of the base as shown in FIG. 3. Frame members 44 and 46 are interconnected by fasteners 48 allowing the members to be disassembled when removing the form from the cast deck 26.

Prior to casting the deck 26, a series of conduits 58 are installed through holes 50 in the longer form members 46. To prevent sagging, a stiff rigid supporting rod is installed within the conduit to stiffen the conduits, which may be fabricated from inexpensive plastic tubing.

Prior to installing the conduits 28, a non-skid deck mat 52 (not visible in FIG. 3) is positioned on the base 40 of the form 38. Positioned above the mat 52 is a first layer of wire mesh 34 the conduits 28, and then a second layer of wire mesh 34 as shown in FIG. 2. Form 38 is then filled with a concrete mix that may be ordinary mix or a specialty, light-weight mix. It is to be noted that because of the light-weight construction design of the float module 12, the more expensive, light-weight concrete mix need not be used, except where added buoyancy is desired. When the poured deck 26 has been adequately cured, the frame 42 is removed from the base 40 and the projecting conduit ends 54 are cut flush with the projecting edge 32 of the deck 26.

Using the construction-grade adhesive, the foam blank 19 is bonded to the deck 26. When the float module 12 is to be used in a salt water environment, the blank 19 is coated with a protective coating 36. In the preferred embodiment a first coat of polyurethane is applied with a grooved trowel in a uniform first layer. After curing, a second smooth layer is applied over the first layer to provide a protective coating approximately ⅛ inch in thickness. Since the deck 26 need only be approximately 4 inches in thickness, the added weight of the protective coating 36 is minimal, and only marginally affects the flotation of the foam pontoon and concrete deck assembly.

As noted, because of the simplicity in fabricating the form, a number of forms can be inexpensively fabricated for casting a number of float modules at a location close to the assembly location of the float apparatus. In this manner, substantial transport costs can be avoided and the float modules can be scheduled to be fabricated at a rate that compliments the rate of assembling float modules into the concrete float apparatus designed for the particular dock site under construction.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A float module for a floating dock comprising:

a concrete deck having a top and a substantially flat underside, and, a foam pontoon having a substantially flat top, wherein the flat top of the foam pontoon is directly bonded to the flat underside of the concrete deck with an adhesive.

2. The float module of claim 1 wherein the foam pontoon bonded to the underside of the concrete deck has an exposed surface with a protective surface coating.

3. The float module of claim 2 wherein the protective surface coating has anti-fouling properties.

4. The float module of claim 3 wherein the protective surface coating is a polyurethane mastic.

5. The float module of claim 3 wherein the protective surface coating is a bituminous mastic.

6. The float module of claim 2 wherein the protective surface coating is a plaster composition.

7. The float module of claim 1 wherein the adhesive is a construction-grade adhesive.

8. The float module of claim 1 wherein the concrete deck has a series of rod bolt conduits through the deck.

9. The float module of claim 1 comprising further a mat bonded to the top of the deck.

10. The float module of claim 1 in combination with at least one other float module with means for interconnecting the float modules to form a float apparatus.

11. The float module of claim 10 wherein the means for interconnecting the float modules comprises a series of conduits through the deck of each module and elongated interconnecting stringers fastened to the float modules by rod bolts extending through the decks fastening the stringers to the decks of multiple modules.

12. The float module of claim 1 wherein the top of the foam pontoon has a channel utilizable as a utility chase.

13. A float module for a floating dock comprising:

a concrete deck having a top and an underside, and, a foam pontoon bonded to the underside of the concrete deck with an adhesive wherein the foam pontoon bonded to the underside of the concrete deck has an exposed surface with a protective surface coating having anti-fouling properties, wherein the protective surface coating is a polyurethane mastic.

14. A float module for a floating dock comprising:

a concrete deck having a top and an underside, and, a foam pontoon bonded to the underside of the concrete deck with an adhesive wherein the foam pontoon bonded to the underside of the concrete deck has an exposed surface with a protective surface coating having anti-fouling properties, wherein the protective surface coating is a bituminous mastic.

15. A float module for a floating dock comprising:

a concrete deck having a top and an underside, and, a foam pontoon bonded to the underside of the concrete deck with an adhesive wherein the foam pontoon bonded to the underside of the concrete deck has an exposed surface with a protective surface coating having anti-fouling properties, wherein the protective surface coating is a plaster composition.

* * * * *